US009021659B2

(12) United States Patent
Lin

(10) Patent No.: US 9,021,659 B2
(45) Date of Patent: May 5, 2015

(54) HINGE STRUCTURE

(71) Applicant: Che-Hsien Lin, Taipei (TW)

(72) Inventor: Che-Hsien Lin, Taipei (TW)

(73) Assignee: Compal Electronics, Inc., Taipei (TW)

( * ) Notice: Subject to any disclaimer, the term of this patent is extended or adjusted under 35 U.S.C. 154(b) by 0 days.

(21) Appl. No.: 14/221,282

(22) Filed: Mar. 21, 2014

(65) Prior Publication Data

US 2015/0020351 A1 Jan. 22, 2015

Related U.S. Application Data

(60) Provisional application No. 61/856,016, filed on Jul. 18, 2013.

(51) Int. Cl.
*E05D 3/06* (2006.01)
*E05D 3/12* (2006.01)

(52) U.S. Cl.
CPC ..... *E05D 3/12* (2013.01)

(58) Field of Classification Search
CPC ..... E05D 3/12; E05D 3/06; E05D 3/10; G06F 1/1681; G06F 1/1616; G06F 1/1618; E05Y 2900/606; H04M 1/0216; H04M 1/0222; H04M 1/022; H05K 5/0226
USPC ..... 16/366, 368, 369, 340, 337, 334, 389, 16/357, 360, 361, 342, 330, 303; 361/679.6, 679.9, 679.17, 679.27; 248/917–923, 284.1; 379/433.12, 379/433.13; 455/575.1, 575.3, 575.4, 455/550.1, 90.3; 348/333.06, 373, 794
See application file for complete search history.

(56) References Cited

U.S. PATENT DOCUMENTS

| | | | | |
|---|---|---|---|---|
| 6,553,625 | B2 * | 4/2003 | Lin et al. | 16/342 |
| 7,380,313 | B2 * | 6/2008 | Akiyama et al. | 16/367 |
| 7,797,797 | B2 * | 9/2010 | Chiang et al. | 16/367 |
| 8,776,319 | B1 * | 7/2014 | Chang et al. | 16/366 |
| 2002/0038493 | A1 * | 4/2002 | Ko et al. | 16/303 |
| 2005/0122671 | A1 * | 6/2005 | Homer | 361/681 |
| 2009/0000062 | A1 * | 1/2009 | Yamanami | 16/366 |
| 2010/0071159 | A1 * | 3/2010 | Myung | 16/303 |
| 2011/0265288 | A1 * | 11/2011 | Chiang | 16/341 |
| 2012/0206893 | A1 * | 8/2012 | Bohn et al. | 361/807 |
| 2013/0016489 | A1 * | 1/2013 | Yeh et al. | 361/807 |
| 2013/0016492 | A1 * | 1/2013 | Wang et al. | 361/820 |
| 2013/0318746 | A1 * | 12/2013 | Kuramochi | 16/342 |

* cited by examiner

*Primary Examiner* — Chuck Mah
(74) *Attorney, Agent, or Firm* — Jianq Chyun IP Office

(57) ABSTRACT

A hinge structure includes a first shaft, a second shaft, a pivot base and a position-limiting mechanism. The first and second shafts are pivoted on the pivot base. The position-limiting mechanism includes a first position-limiting portion, a second position-limiting portion and a position-limiting component. The first position-limiting portion is fixed to the first shaft. The second position-limiting portion is fixed to the second shaft. The position-limiting component is slidably disposed on the pivot base and has first and second ends opposite to each other. When the position-limiting component moves to a first position, the first end and the first position-limiting portion interfere with each other to stop the first shaft and the pivot base from rotating relatively. When the position-limiting component moves to a second position, the second end and the second position-limiting portion interfere with each other to stop the second shaft and the pivot base from rotating relatively.

11 Claims, 14 Drawing Sheets

HINGE STRUCTURE

CROSS-REFERENCE TO RELATED APPLICATION

This application claims the priority benefits of U.S. provisional application Ser. No. 61/856,016, filed on Jul. 18, 2013. The entirety of the above-mentioned patent application is hereby incorporated by reference herein and made a part of this specification.

BACKGROUND OF THE INVENTION

1. Field of the Disclosure

The invention generally relates to a hinge structure and particularly to a hinge structure with two shafts.

2. Description of Related Art

Since the notebook computer has the same functions with the desktop computer and is convenient for the user to take along with for its thin and light-weighted design, the notebook computer has become one of indispensible belongings for some of users. As the prices for notebook computers continue to drop, some of users even replace desktop computers with notebook computers.

Generally, a notebook computer is composed of a base and a display. In order for the notebook computer to please consumers by its various operation and ways of using, some of displays for notebook computers are designed to make the configuration of the notebook computer becoming similar to that of the panel computer by turning the display over to the back of the base. As a result, the design of the hinge structure for notebook computers needs to be improved accordingly so that the user can turn the display over smoothly to the back of the base

SUMMARY OF THE INVENTION

Accordingly, the invention is directed to a hinge structure which enables a display of an electronic device to be turned over smoothly to a back of a base.

A hinge structure of the invention includes a first shaft, a second shaft, a pivot base and a position-limiting mechanism. The first shaft and the second shaft are pivoted on the pivot base. The position-limiting mechanism includes a first position-limiting portion, a second position-limiting portion and a position-limiting component. The first position-limiting portion is fixed to the first shaft. The second position-limiting portion is fixed to the second shaft. The position-limiting component is slidably disposed on the pivot base and has a first end and a second end opposite to each other. When the position-limiting component moves to a first position, the first end and the first position-limiting portion interfere with each other to stop the first shaft and the pivot base from rotating relatively. When the position-limiting component moves to a second position, the second end and the second position-limiting portion interfere with each other to stop the second shaft and the pivot base from rotating relatively.

According to an embodiment of the invention, the first shaft is pivoted on the pivot base along a first axis, the second shaft is pivoted on the pivot base along a second axis, the position-limiting component slidably disposed on the pivot base along a third axis; and the first axis, the second axis and the third axis are parallel to each other.

According to an embodiment of the invention, the hinge structure further includes a first bracket and a second bracket, wherein the first bracket and the second bracket are fixed on the first shaft and the second shaft respectively, and an expanding angle between the first bracket and the second bracket is adapted to be changed through the relative pivoting between the first shaft and the pivot base or the relative pivoting between the second shaft and the pivot base.

According to an embodiment of the invention, the hinge structure is suitable for an electronic device, wherein the electronic device includes a display and a base, the first bracket and the second bracket connect to the display and the base respectively.

According to an embodiment of the invention, when the expanding angle is less than a first angle or greater than a second angle, the position-limiting component is limited to the second position, and when the expanding angle is greater than the first angle and less than the second angle, the position-limiting component is limited to the first position.

According to an embodiment of the invention, the first angle is 90 degrees and the second angle is 270 degrees.

According to an embodiment of the invention, the hinge structure further includes a stop structure, wherein the second shaft is pivoted on the stop structure and has a bump, the stop structure has a stop block, when the expanding angle increases to the second angle through the relative pivoting between the second shaft and the pivot base, the bump contacts the stop block to stop the second shaft and the pivot base from continuing to pivot relatively, and when the expanding angle decreases to the first angle through the relative pivoting between the second shaft and the pivot base, the bump contacts the stop block to stop the second shaft and the pivot base from continuing to pivot relatively.

According to an embodiment of the invention, the hinge structure further includes a stop structure, wherein the first shaft is pivoted on the stop structure and has a bump, the stop structure has a stop block, when the expanding angle increases to a third angle greater than the second angle through the relative pivoting between the first shaft and the pivot base, the bump contacts the stop block to stop the second shaft and the pivot base from continuing to pivot relatively, and when the expanding angle decreases to a fourth angle less than the first angle through the relative pivoting between the first shaft and the pivot base, the bump contacts the stop block to stop the first shaft and the pivot base from continuing to pivot relatively.

According to an embodiment of the invention, the third angle is 360 degrees and the fourth angle is 0 degree.

According to an embodiment of the invention, the position-limiting mechanism further includes an elastic component which connects to the place between the position-limiting component and the pivot base, the position-limiting component is adapted to be limited to the first position via the elastic force of the elastic component and the first position-limiting portion is adapted to resist the elastic force of the elastic component and limits the position-limiting component to the second position.

According to an embodiment of the invention, the first position-limiting portion has a first concave portion, the second position-limiting portion has at least one second concave portion, when the position-limiting component is located at the first position, the first end sticks into the first concave portion to stop the relative pivoting between the first shaft and the pivot base, and when the position-limiting component is located at the second position, the second end sticks into the second concave portion to stop the relative pivoting between the second shaft and the pivot base.

According to an embodiment of the invention, there is at least one guiding-incline inside the first concave portion, when the position-limiting component is located at the first position and the second end is aligned to the second concave portion, the first end is adapted to move away from the first concave portion along the guiding-incline through the relative pivoting between the first shaft and the pivot base, so as to drive the position-limiting component to move from the first position to the second position.

In light of the foregoing descriptions, the first bracket and the second bracket of the hinge structure in the invention could connect to the display and the base of the electronic device respectively, and the hinge structure has a position-limiting mechanism which is used to control the pivoting state of the first shaft and the second shaft. In the above mentioned position-limiting mechanism, when the position-limiting component interferes with the first position-limiting portion, the first shaft is restricted from pivoting relatively to the pivot base, and when the position-limiting component interferes with the second position-limiting portion, the second shaft is restricted from pivoting relatively to the pivot base. As a result, in the process that the user turns over the display of the electronic device, the first shaft and the second shaft can be restricted to pivot in order instead of pivoting simultaneously, so as to avoid unexpected operations caused by forces exerted by the user. Thus, the display of the electronic device can be turned over smoothly between the front side and the back side of the base via the first shaft and the second shaft.

BRIEF DESCRIPTION OF THE DRAWINGS

The accompanying drawings are included to provide a further understanding of the invention, and are incorporated in the constitute a part of this specification. The drawings illustrate embodiments of the invention and, together with the description, serve to explain the principles of the invention.

DESCRIPTION OF EMBODIMENTS

Figure 1:
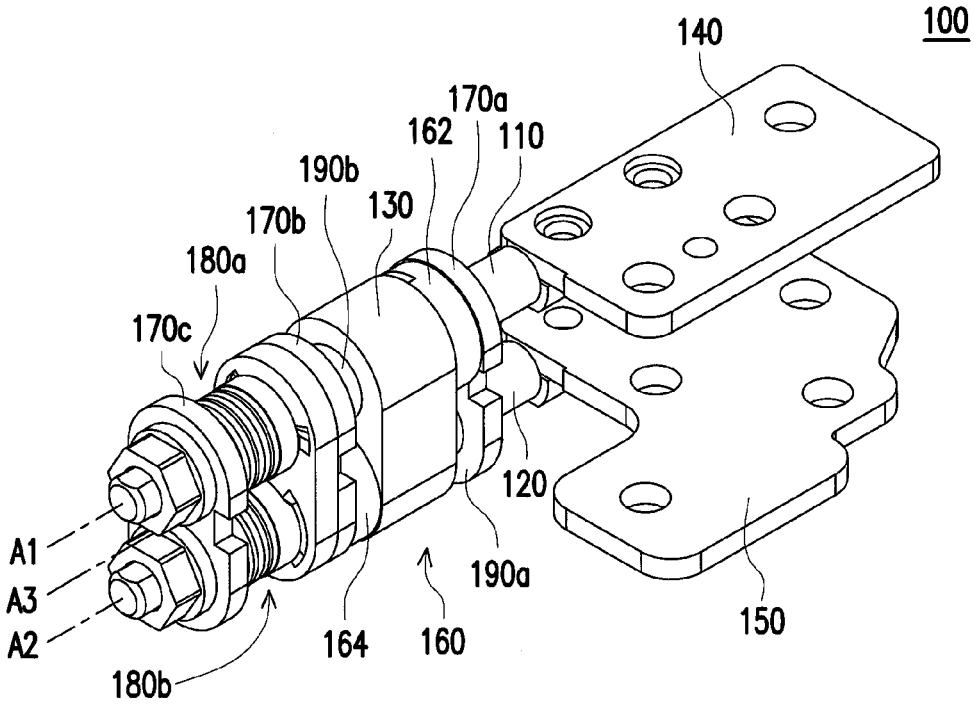
FIG. 1 is a perspective view of the hinge structure according to one embodiment of the invention.

Reference will now be made in detail to the present embodiments of the invention, examples of which are illustrated in the accompanying drawings. Wherever possible, the same reference numbers are used in the drawings and the description to refer to the same or like parts.

Figure 2:
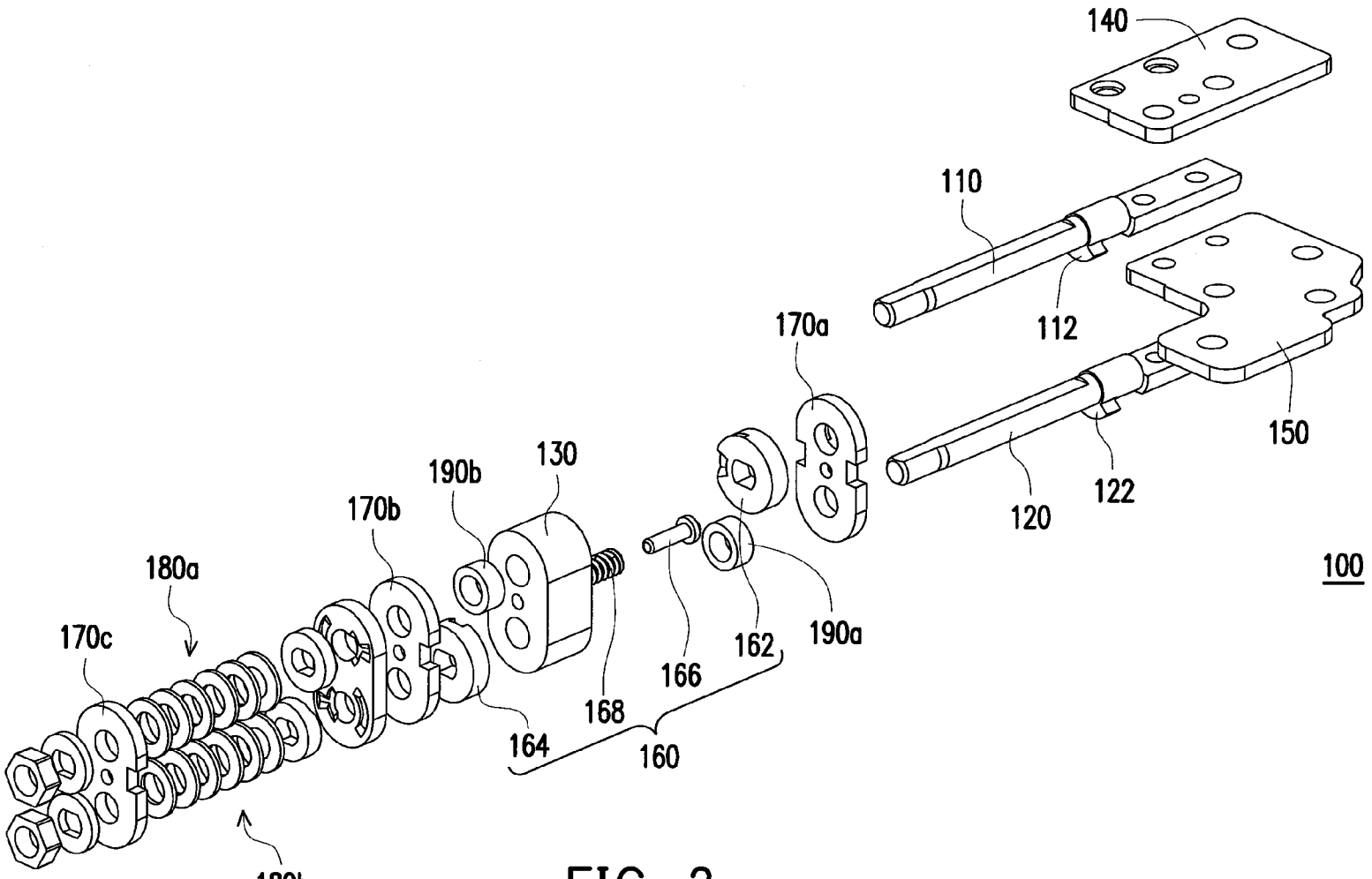
FIG. 2 is an exploded view of the hinge structure according to FIG. 1.
Figure 3A:
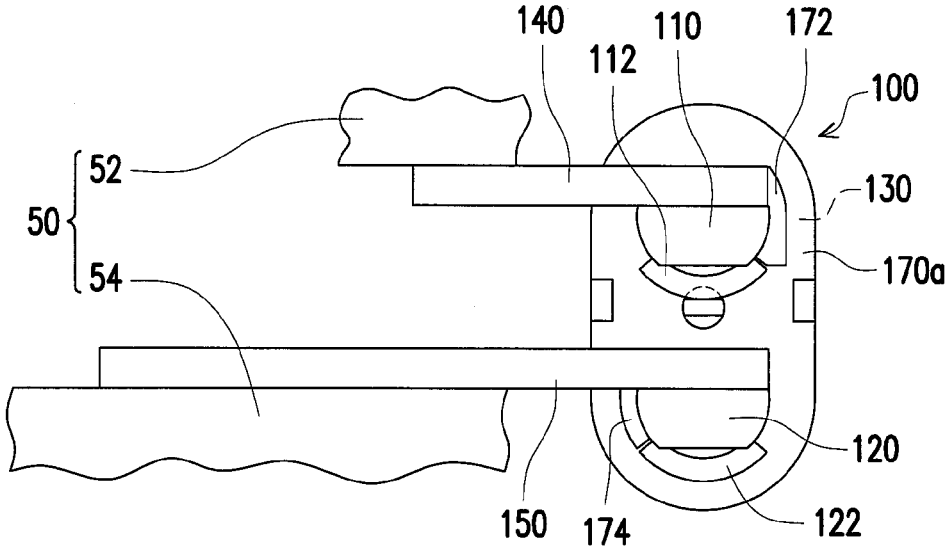
FIG. 3A to FIG. 3E illustrate an operation flow of the hinge structure applied to the electronic device in FIG. 1.

FIG. 1 is a perspective view of the hinge structure according to one embodiment of the invention. FIG. 2 is an exploded view of the hinge structure according to FIG. 1. FIG. 3A to FIG. 3E illustrate an operation flow of the hinge structure applied to the electronic device in FIG. 1. Referring to FIG. 1, FIG. 2 and FIG. 3A, the hinge structure 100 in the embodiment includes a first shaft 110, a second shaft 120, a pivot base 130, a first bracket 140 and a second bracket 150. The first shaft 110 is pivoted on the pivot base 130 along a first axis A1, the second shaft 120 is pivoted on the pivot base 130 along a second axis A2 which is parallel to the first axis A1. The first bracket 140 and the second bracket 150 are fixed on the first shaft 110 and the second shaft 120 respectively. An expanding angle between the first bracket 140 and the second bracket 150 are adapted to be changed through the relative pivoting between the first shaft 110 and the pivot base 130 or the relative pivoting between the second shaft 120 and the pivot base 130.

As shown in FIG. 3A, the hinge structure 100 in the embodiment can be applied to the electronic device 50. The electronic device 50 is a notebook computer for example and includes a display 52 and a base 54. The display 52 and the base 54 connect to the first bracket 140 and the second bracket 150 respectively so that the display 52 can be turned over relatively to the base 54 via the action of the hinge structure 100 as shown from FIG. 3A to FIG. 3E.

Figure 3E:
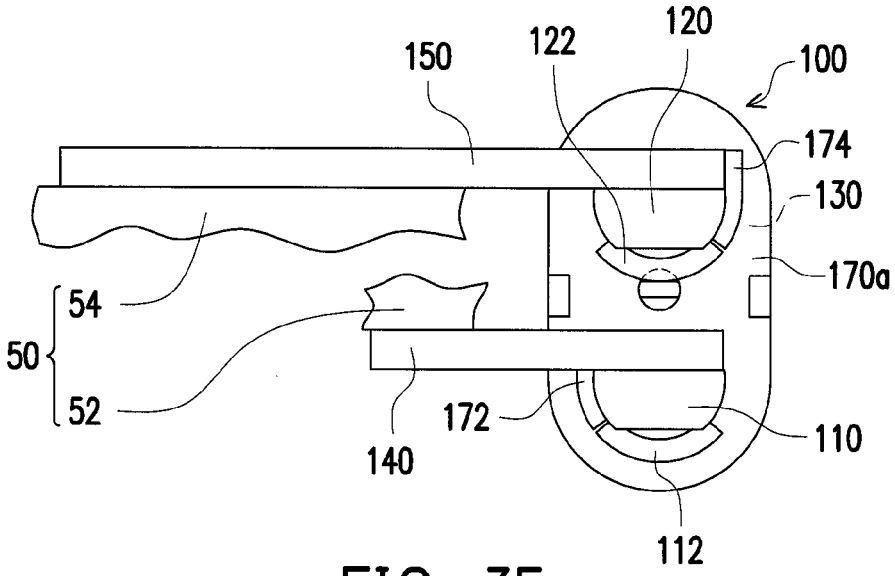
Figure 4A:
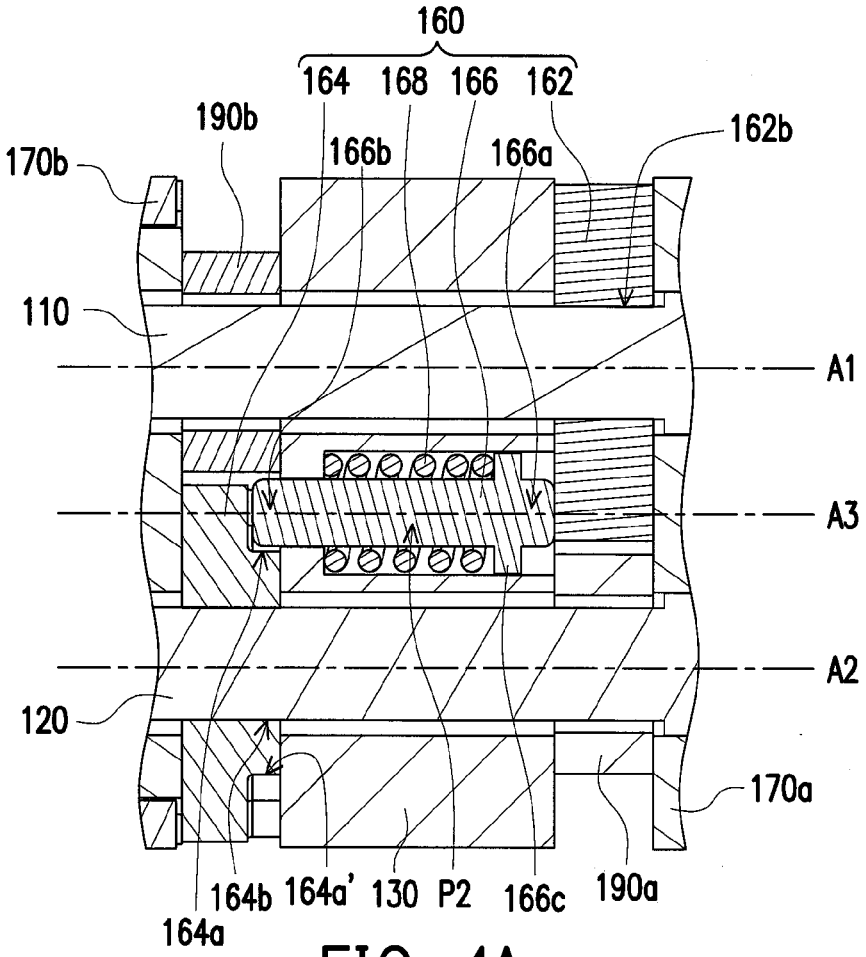
FIG. 4A to FIG. 4E illustrate an operation flow of the position-limiting mechanism in FIG. 1.
Figure 4B:
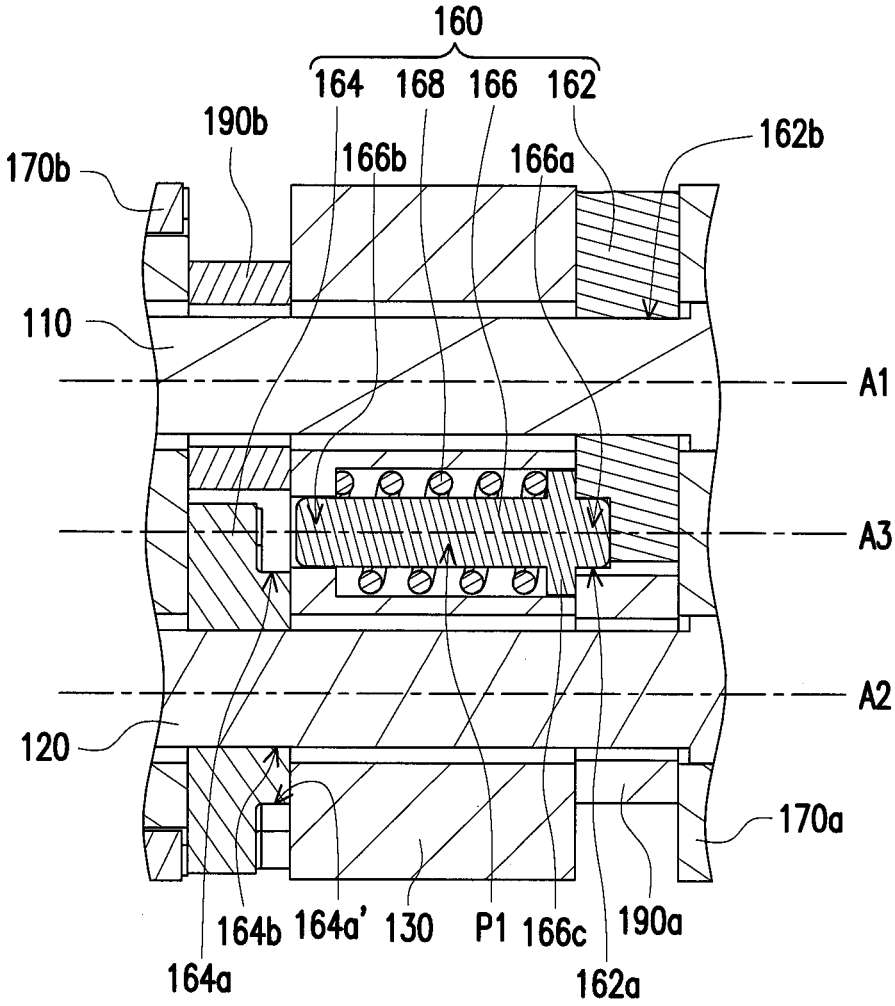
Figure 4C:
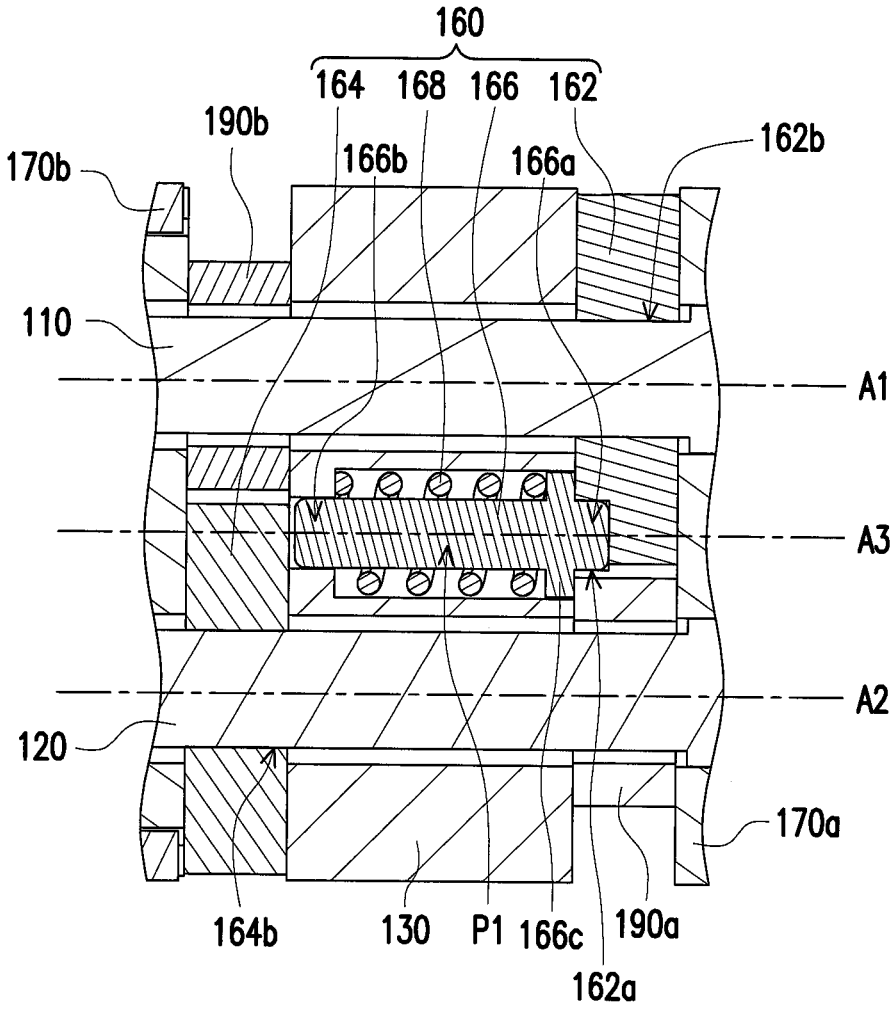
Figure 4D:
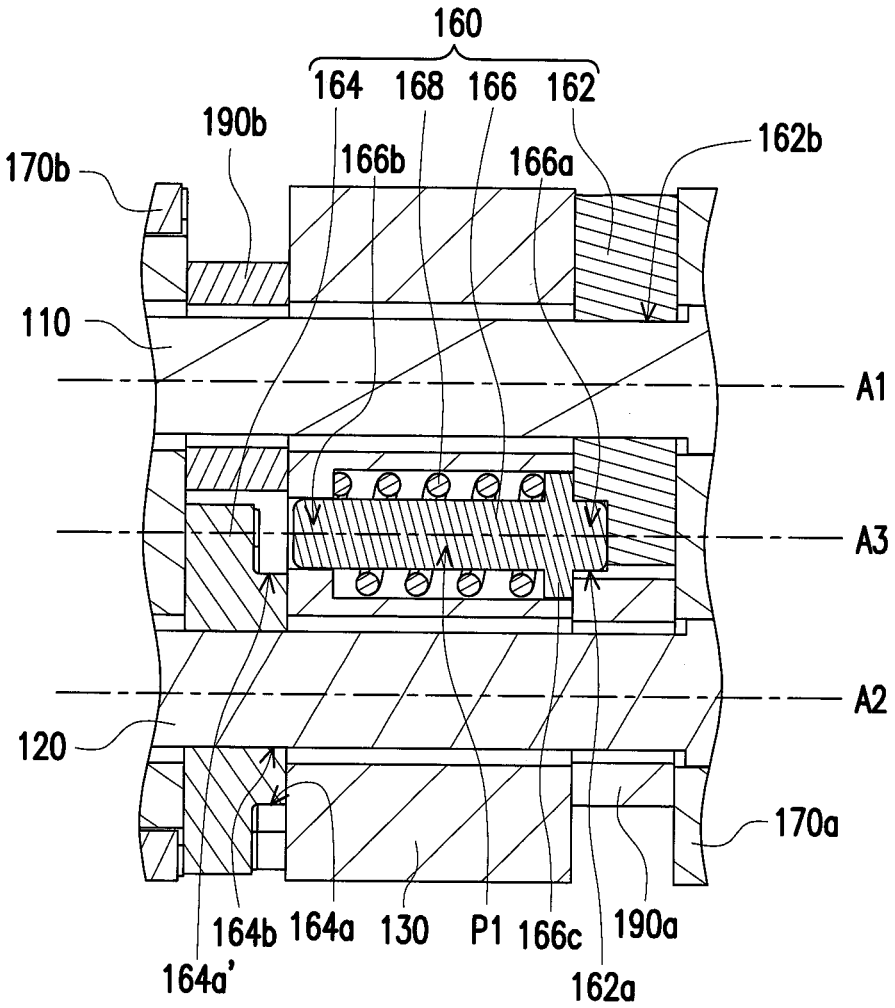
Figure 4E:
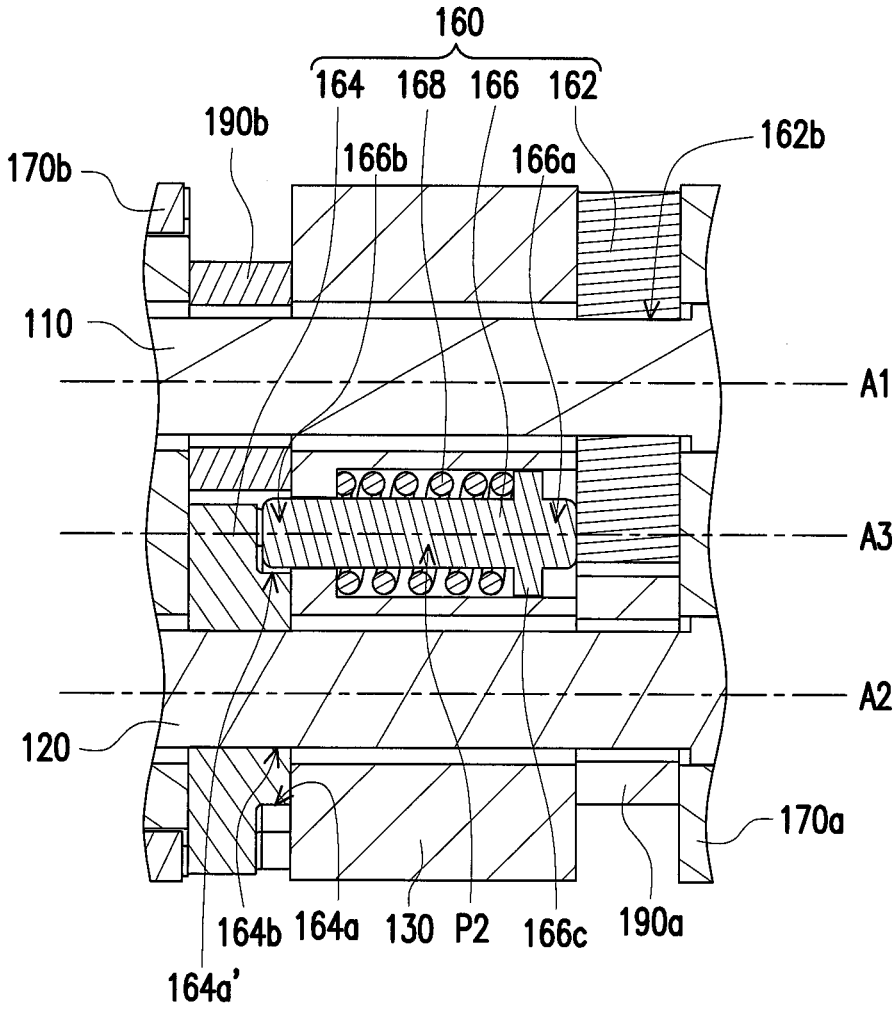

FIG. 4A to FIG. 4E illustrate an operation flow of the position-limiting mechanism in FIG. 1. Referring to FIG. 2 and FIG. 4A, the hinge structure 100 of the embodiment includes a position-limiting mechanism 160. The position-limiting mechanism 160 includes a first position-limiting portion 162, a second position-limiting portion 164 and a position-limiting component 166. The first position-limiting portion 162 is fixed to the first shaft 110, and the second position-limiting portion 164 is fixed to the second shaft 120. The position-limiting component 166 is slidably disposed on the pivot base 130 along a third axis A3 which is parallel to the first axis A1 and the second axis A2, also the position-limiting component 166 has a first end 166*a* and a second end 166*b* opposite to each other. When the position-limiting component 166 moves to a first position P1 as shown in FIG. 4B, FIG. 4C or FIG. 4D, the first end 166*a* interferes with the first position-limiting portion 162 to stop the first shaft 110 and the pivot base 130 from pivoting relatively. When the position-limiting component 166 moves to a second position P2 as shown in FIG. 4A or FIG. 4E, the second end 166*b* and the second position-limiting portion 164 interfere with each other to stop the second shaft 120 and the pivot base 130 from pivoting relatively. As a result, in the process that the user turns over the display 52 closed on the front side of the base 54 (as shown in FIG. 3A) to the back side of the base 54 (as shown in 3E) or turns over the display 52 on the back side of the base 54 (as shown in FIG. 3E) to the front side of the base 54 (as shown in 3A), the first shaft 110 and the second shaft 120 can be restricted to pivot in order instead of pivoting simultaneously via the above mentioned action of the position-limiting mechanism 160, so as to avoid unexpected operations caused by forces exerted by the user. Thus, the display 52 of the electronic device 50 can be turned over smoothly between the front side and the back side of the base 54 via the first shaft 110 and the second shaft 120.

Figure 5:
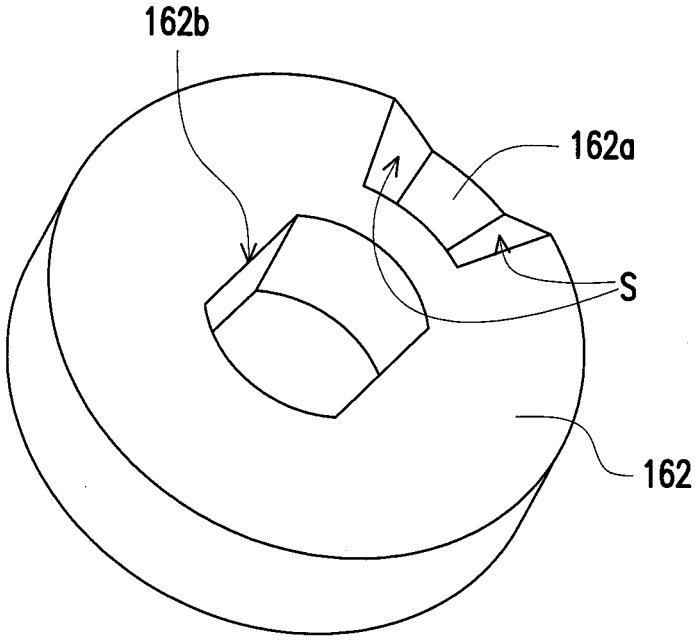
FIG. 5 is a perspective view of the first position-limiting portion in FIG. 1.
Figure 6:
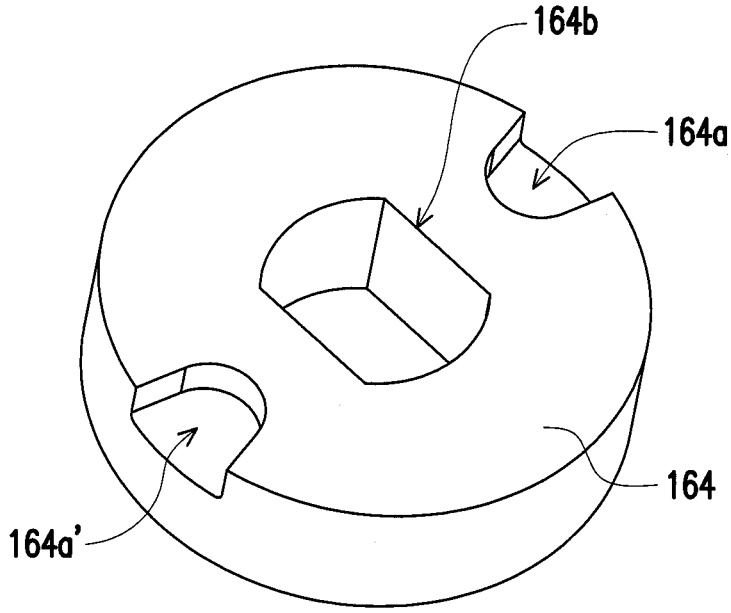
FIG. 6 is a perspective view of the second position-limiting portion in FIG. 1.
Figure 7:
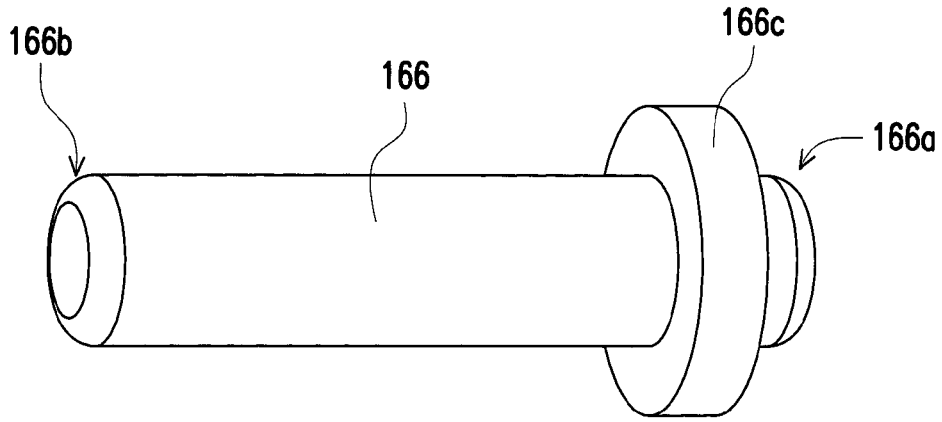
FIG. 7 is a perspective view of the position-limiting component in FIG. 2.

In the following the configurations of the position-limiting mechanism 160 in the embodiment are illustrated by figures in detail. FIG. 5 is a perspective view of the first position-limiting portion in FIG. 1. FIG. 6 is a perspective view of the second position-limiting portion in FIG. 1. FIG. 7 is a perspective view of the position-limiting component in FIG. 2. In the embodiment, the first position-limiting portion 162 has a first concave portion 162*a* and a through hole 162*b* as shown in FIG. 5, and the second position-limiting portion 164 has at least one second concave portion (two are shown and marked as 164*a* and 164*a'*) and a through hole 164*b* as shown in FIG. 6. The position-limiting mechanism 160 further includes an elastic component 168 as shown in FIG. 4A, and the position-limiting component 166 has a ring-shaped flange 166*c* as shown in FIG. 7. The elastic component 168 is a compressed spring for example and is fitted around the position-limiting component 166 as shown in FIG. 4A to FIG. 4E to connect between the ring-shaped flange 166*c* of the position-limiting component 166 and the pivot base 130. The through hole 162*b* and the through hole 164*b* are non-circular holes for example and the first shaft 110 and the second shaft 120 are disposed through the through hole 162 and the through holed 164 respectively as shown in FIG. 4A to FIG. 4E, so that the first shaft 110 and the first position-limiting portion 162 are fixed to each other and can not rotate relatively, also the second shaft 120 and the second position-limiting portion 164 are fixed to each other and can not rotate relatively.

The position-limiting component 166 is adapted to be limited to the first position P1 as shown in FIGS. 4B, 4C or 4D via the elastic force of the elastic component 168. Here the first end 166*a* sticks into the first concave portion 162*a* of the first position-limiting portion 162 so that the position-limiting component 166 interferes with the first position-limiting portion 162 to stop the first shaft 110 and the pivot base 130 from pivoting relatively, and to enable the second shaft 120 and the pivot base 130 to pivot relatively. The first position-limiting portion 162 is adapted to resist the elastic force of the elastic component 168 and limits the position-limiting component 166 to the second position P2 as shown in FIG. 4A or FIG. 4E. Here the second end 166*b* of the position-limiting component 166 sticks into the second concave portion 164*a* or the concave portion 164*a'* of the second position-limiting portion 164 to stop the second shaft 120 and the pivot base 130 from pivoting relatively.

Figure 8A:
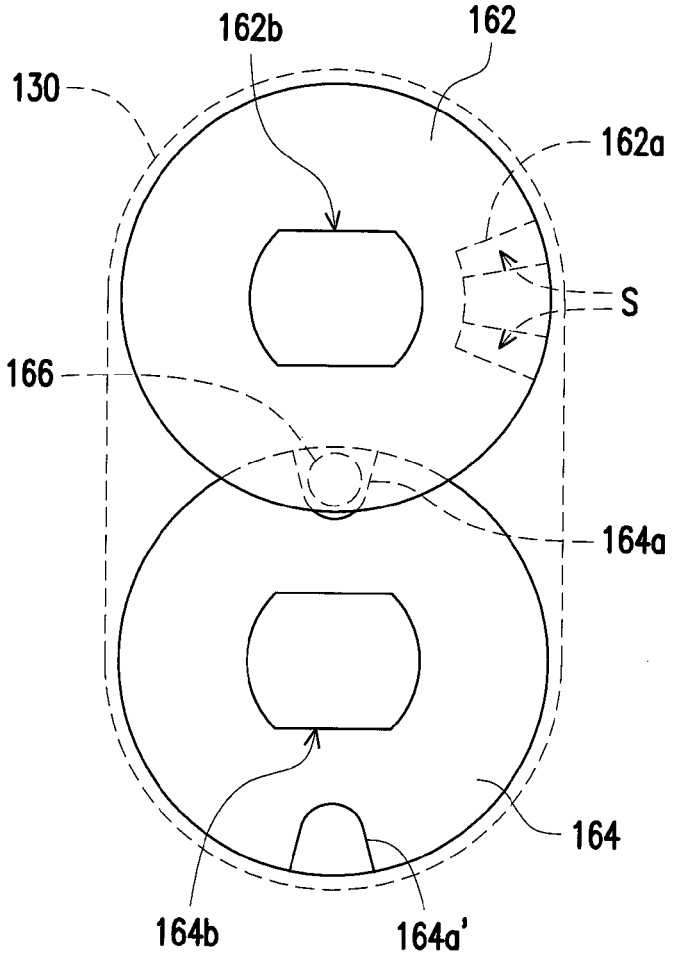
FIG. 8A to FIG. 8E are schematic views on part of components of the hinge structure in FIG. 3A to FIG. 3E.

In the following the operation processes of the electronic device 50 and the hinge structure 100 in the embodiment based on above mentioned configurations are illustrated by figures. FIG. 8A to FIG. 8E are schematic views on part of components of the hinge structure in FIG. 3A to FIG. 3E. When the first bracket 140 is located at the front side of the second bracket 120 as shown in FIG. 3A, the second concave portion 164*a* of the second position-limiting portion 164 is aligned to the position-limiting component 166 as shown in FIG. 8A, the first concave portion 162*a* of the first position-limiting portion 162 is not aligned to the position-limiting component 166 as shown in FIG. 8A, and the first position-limiting portion 162 resists the elastic force of the elastic component 168 and limits the position-limiting component 166 to the second position P2 as shown in FIG. 4A. Here the position-limiting component 166 do not interfere with the first position-limiting portion 162 and the second end 166*b* of the position-limiting component 166 sticks into the second concave portion 164*a* of the second position-limiting portion 164, so as to restrict the second shaft 120 and the pivot base 130 from pivoting relatively via the interference between the second end 166*b* and the second concave portion 164*a*. Accordingly, when the user turns over the display 52 of the hinge structure 100 in the state illustrated in the FIG. 3A, the force exerted by the user will drive the first shaft 110 and the pivot state 130 to pivot relatively until the hinge structure 100 act to the state illustrated in FIG. 3B.

Figure 3B:
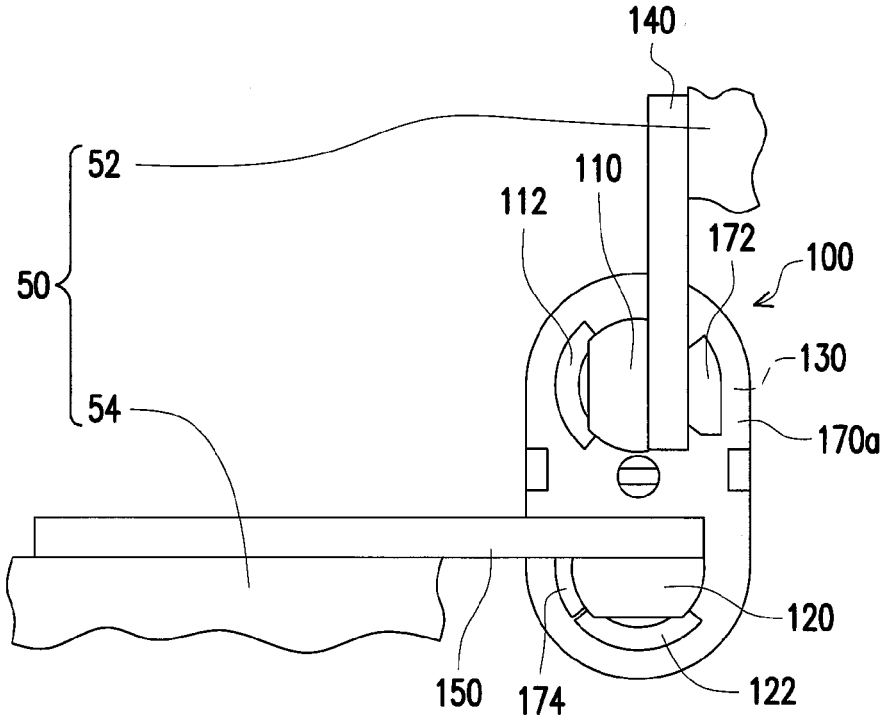
Figure 3C:
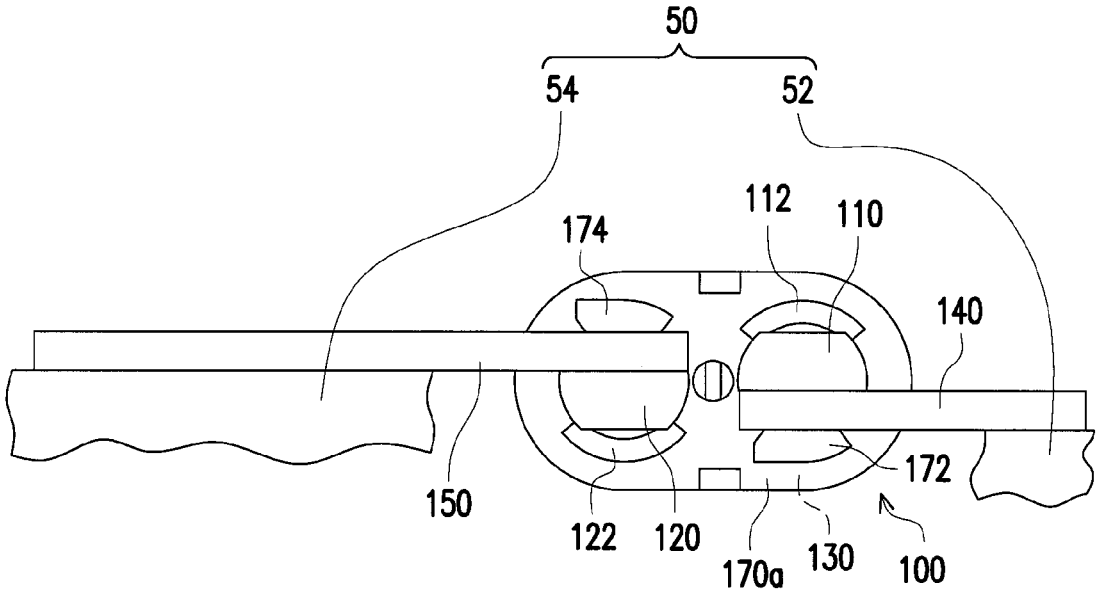
Figure 8B:
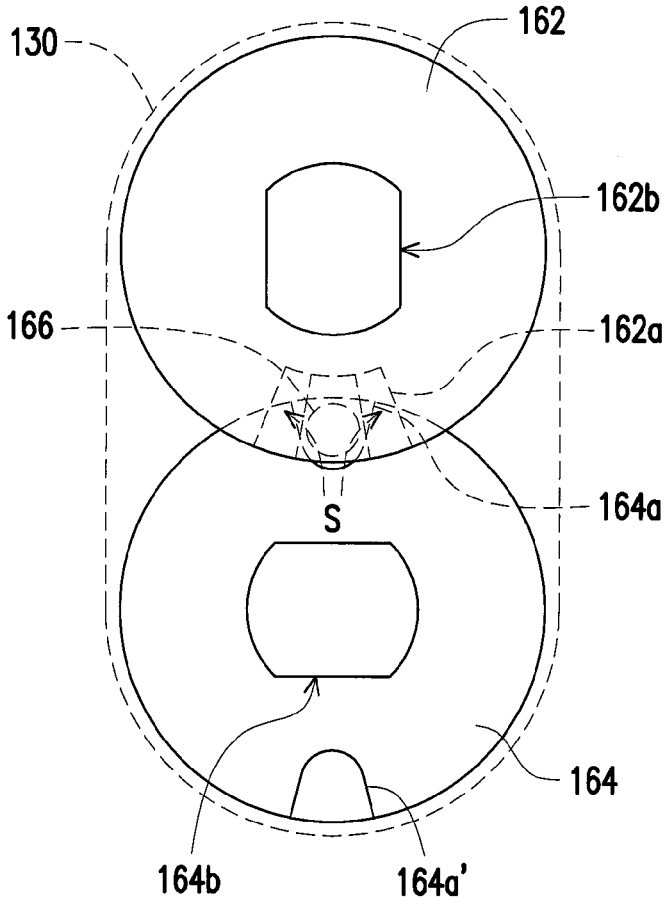
Figure 8C:
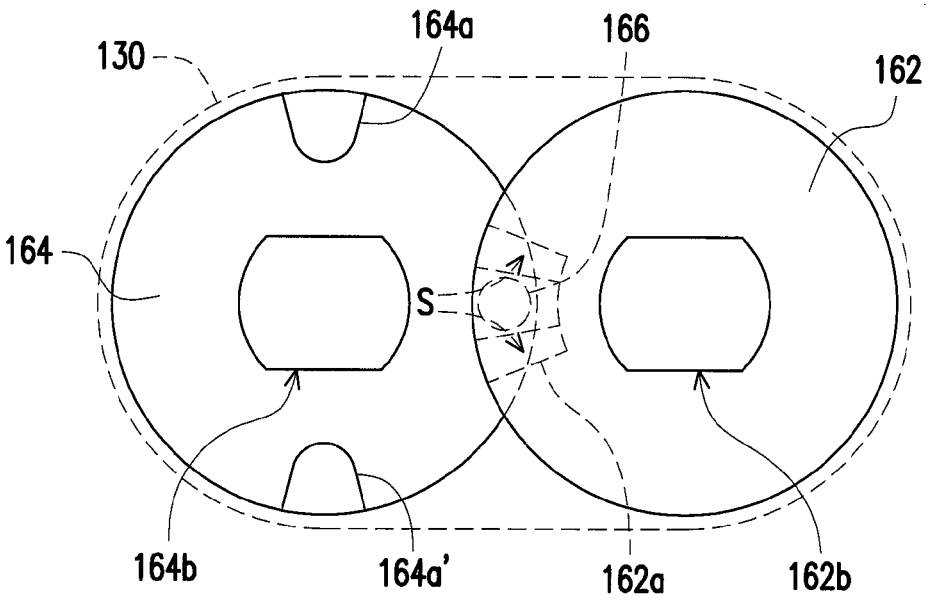

When the expanding angle of the first bracket 140 relative to the second bracket 150 (which is equal to the expanding angle of the display 52 relative to the base 54) increases to a first angle (depicted as 90 degrees)as shown in FIG. 3B through the relative pivoting between the first shaft 110 and the pivot base 130, the first concave portion 162*a* of the first position-limiting portion 162 is aligned to the position-limiting element 166 as shown in FIG. 8B through the relative pivoting between the first position-limiting portion 162 and the pivot base 130. Here the position-limiting element 166 moves toward the first position-limiting portion 162 and is limited to the first position P1 via the elastic force of the elastic component 168 as shown in FIG. 4B, so that the position-limiting element 166 does not interfere with the second position-limiting portion 164 anymore and the first end 166*a* of the position-limiting element 166 sticks into the first concave portion 162*a* of the first position-limiting portion 162, so as to restrict the first shaft 110 and the pivot base 130 from pivoting relatively via the interference between the first end 166*a* and the first concave portion 162*a*. Accordingly, when the user continues to turn over the display 52 while the hinge structure 100 is in the state illustrated in FIG. 3B, the force exerted by the user will drive the first shaft 120 and the pivot state 130 to pivot relatively, so as to drive the electronic device 50 and the hinge structure 100 act to the state illustrated in FIG. 3C, and then drive the electronic device 50 and the hinge structure 100 act to the state illustrated in FIG. 3D.

Figure 8D:
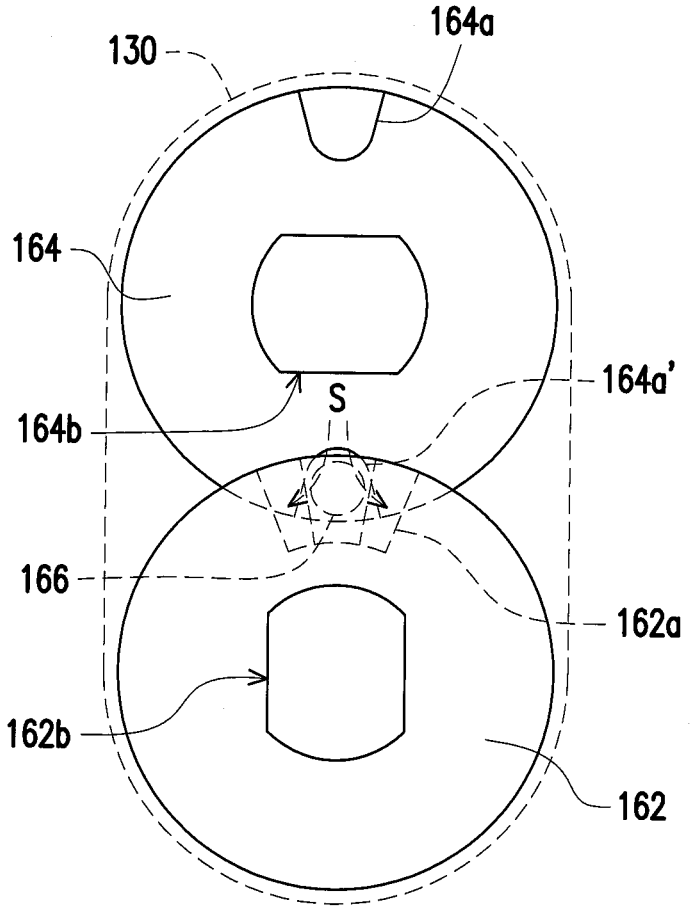

Referring to FIG. 1 and FIG. 2, the hinge structure 100 of the embodiment further includes a stop structure 170*a*. The first shaft 110 is pivoted on the stop structure 170*a* along the first axis A1 and has a bump 112, and the second shaft 120 is pivoted on the stop structure 170*a* along the second axis A2 and has a bump 122. As shown in FIG. 3A to FIG. 3E, the stop structure 170*a* has a stop block 172 and a stop block 174. When the expanding angle of the first bracket 140 relative to the second bracket 150 increases to a second angle (depicted as 270 degrees) through the relative pivoting between the second shaft 120 and the pivot base 130, the bump 122 contacts the stop block 174 to stop the second shaft 120 and the pivot base 130 from continuing to pivot relatively, also the second concave portion 164*a'* of the second position-limiting portion 164 is aligned to the position-limiting component 166 as shown in FIG. 8D through the relative pivoting between the second position-limiting portion 164 and the pivot base 130. Accordingly, when the user continues to rotate the display 52 while the hinge structure 100 is in the state illustrated in FIG. 3D, the force exerted by the user drives the first shaft 110 and the pivot base 130 to pivot relatively, and the first end 166*a* of the position-limiting component 166 resists the elastic force of the elastic component 168 and moves away from the first concave portion 162*a* along the guiding-incline S (depicted in FIG. 5) of the first concave portion through the relative pivoting between the first position-limiting portion 162 and the pivot base 130, so as to drive the position-limiting component 166 to move from the first position P1 as shown in FIG. 4D to the second position P2 as shown in FIG. 4E, so that the second shaft 120 and the pivot base 130 are restricted from pivoting relatively via the interference between the second end 166*b* of the position-limiting component 166 and the second end 164*a'* of the second position limiting portion 164. Here the force exerted by the user will drive the electronic device 50 and the hinge structure 100 acts to the state illustrated in FIG. 3E via the relative pivoting between the first shaft 110 and the pivot base 130 and the display 52 is turned over to the back side of the base 54. When the expanding angle of the first bracket 140 relative to the second bracket 150 increases to a third angle (depicted as 360 degrees) greater than the second angle through the relative pivoting between the first shaft 110 and the pivot base 130, the bump 112 contacts the stop block 172 to stop the first shaft 110 and the pivot base 130 from continuing to pivot relatively, so that the display 52 stop acting after being turned over to the back side of the base 54 as shown in FIG. 3E.

Figure 8E:
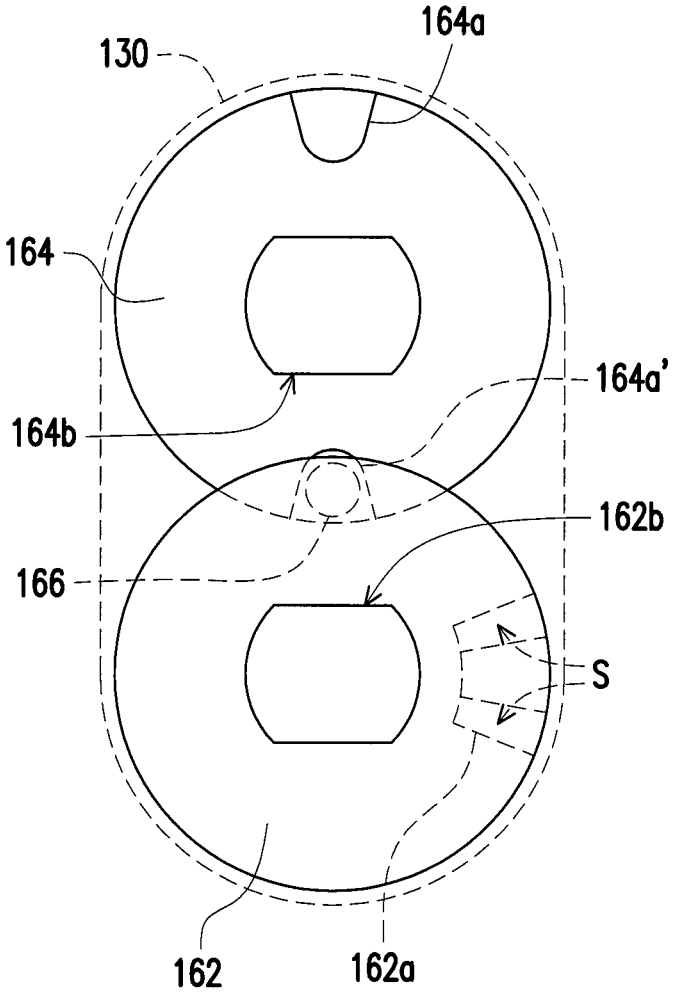

In the following the procedure that the display 52 is restored from the state shown in FIG. 3E to the state shown in 3A is illustrated. When the first bracket 140 is located at the back side of the second bracket 150 as shown in FIG. 3E, the second concave portion 164*a'* of the second position-limiting portion 164 is aligned to the position-limiting component 166 as shown in FIG. 8E, the first concave portion 162*a* of the first position-limiting portion 162 is not aligned to the position-limiting component 166 as shown in FIG. 8E, and the first position-limiting portion 162 resists the elastic force of the elastic component 168 and limits the position-limiting component 166 to the second position P2 as shown in FIG. 4E. Here the position-limiting component 166 do not interfere with the first position-limiting portion 162 and the second end 166*b* of the position-limiting component 166 sticks into the second concave portion 164*a'* of the second position-limiting portion 164, so as to restrict the second shaft 120 and the pivot base 130 from pivoting respectively via the interference between the second end 166*b* and the second concave portion 164*a'*. Accordingly, when the user turn over the display 52 while the hinge structure 100 is in the state illustrated in the FIG. 3E, the force exerted by the user will drive the first shaft 110 and the pivot state 130 to pivot relatively until the hinge structure 100 acts to the state illustrated in FIG. 3D.

Figure 3D:
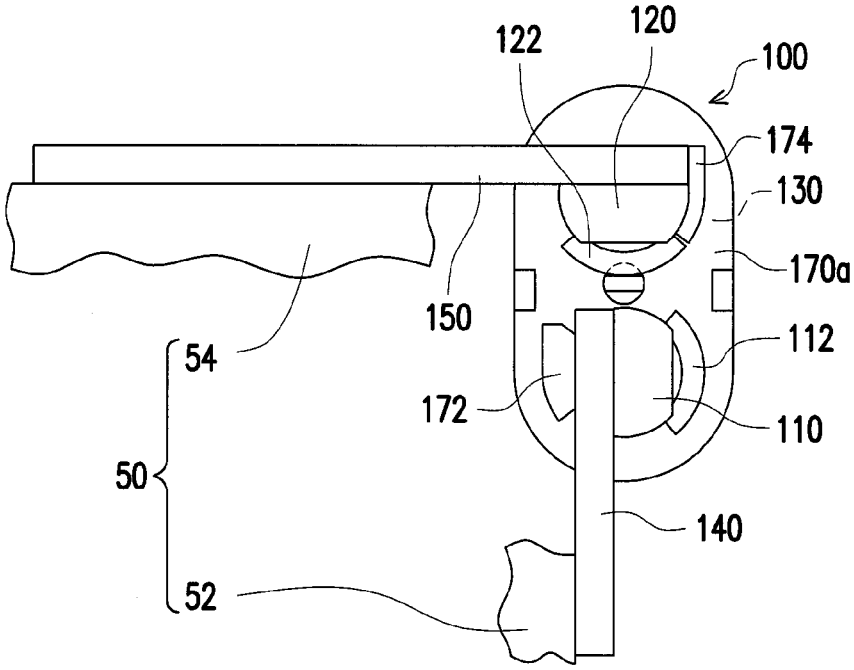

When the expanding angle of the first bracket 140 relative to the second bracket 150 decreases to the above mentioned third angle as shown in FIG. 3D through the relative pivoting between the first shaft 110 and the pivot base 130, the first concave portion 162*a* of the first position-limiting portion 162 is aligned to the position-limiting element 166 as shown in FIG. 8D through the relative pivoting between the first position-limiting portion 162 and the pivot base 130. Here the position-limiting element 166 moves toward the first position-limiting portion 162 and is limited to the first position P1 via the elastic force of the elastic component 168 as shown in FIG. 4D, so that the position-limiting element 166 does not interfere with the second position-limiting portion 164 anymore and the first end 166*a* of the position-limiting element 166 sticks into the first concave portion 162*a* of the first position-limiting portion 162, so as to restrict the first shaft 110 and the pivot base 130 from pivoting relatively via the interference between the first end 166*a* and the first concave portion 162*a*. Accordingly, when the user continues to turn over the display 52 while the hinge structure 100 is in the state shown in FIG. 3D, the force exerted by the user will drive the second shaft 120 to pivot relatively to the pivot base 130, so as to drive the electronic device 50 and the hinge structure 100 act to the state illustrated in FIG. 3C and then drive the electronic device 50 and the hinge structure 100 act to the state illustrated in FIG. 3B.

When the expanding angle of the first bracket 140 relative to the second bracket 150 decreases to the first angle through the relative pivoting between the second shaft 120 and the pivot base 130, the bump 122 contacts the stop block 174 to stop the second shaft 120 and the pivot base 130 from continuing to pivot relatively, also the second concave portion 164*a* of the second position-limiting portion 164 is aligned to the position-limiting component 166 as shown in FIG. 8B through the relative pivoting between the second position-limiting portion 164 and the pivot base 130. Accordingly, when the user continues to turn over the display 52 while the hinge structure 100 is in the state illustrated in FIG. 3B, the force exerted by the user drives the first shaft 110 and the pivot base 130 to pivot relatively, and the first end 166*a* of the position-limiting component 166 will move away from the first concave portion 162*a* along the guiding-incline S (as depicted in FIG. 6) in the first concave portion 162*a* through the relative pivoting between the first position-limiting portion 162 and the pivot base 130, so as to drive the position-limiting component 166 to move from the first position P1 as shown in FIG. 4B to the second position P2 as shown in FIG. 4A, so that the second shaft 120 and the pivot base 130 are restricted from pivoting relatively via the interference between the second end 166*b* of the position-limiting component 166 and the second end 164*a* of the second position-limiting portion 164. Here the force exerted by the user will drive the electronic device 50 and the hinge structure 100 act to the state illustrated in FIG. 3A via the relative pivoting between the first shaft 110 and the pivot base 130 and the display 52 is turned over to the front side of the base 54. When the expanding angle of the first bracket 140 relative to the second bracket 150 decreases to a fourth angle (depicted as 0 degree) less than the first angle through the relative pivoting between the first shaft 110 and the pivot base 130, the bump 112 contacts the stop block 172 to stop the first shaft 110 and the pivot base 130 from continuing to pivot relatively, so that the display 52 stop acting after being turned over to the front side of the base 54 as shown in FIG. 3A.

Under the above mentioned configurations and operation principles, when the expanding angle of the first bracket 140 relative to the second bracket 150 is less than the first angle depicted in FIG. 3B or greater than the second angle depicted in FIG. 3D, the position-limiting element 166 is limited to the second position P2 to stop the relative pivoting between the second shaft 120 and the pivot base 130, and when the expanding angle of the first bracket 140 relative the second bracket 150 is greater than the first angle depicted in FIG. 3B or less than the second angle depicted in FIG. 3D, the position-limiting element 166 is limited to the first position P1 to stop the relative rotation between the first shaft 110 and the pivot base 130. Accordingly, in the process that the user turns over the display 52 closed on the front side of the base 54 to the back side of the base 54, the hinge structure 100 is restricted to pivot by the first shaft 110 first, then pivot by the second shaft 120 and finally pivot by the first shaft 110. Similarly, in the process that the user turns over the display 52 closed on the back side of the base 54 to the front side of the base 54, the hinge structure 100 is restricted to pivot by the first shaft 110 first, then pivot by the second shaft 120 and finally pivot by the first shaft 110. By the above mentioned method of switching pivoting states, it can avoid unexpected operations of the hinge structure 100 caused by forces exerted by the user, so that the display 52 of the electronic device 50 can be turned over smoothly between the front side and the back side of the base 54. In other embodiments, the quantities and positions of concave portions in above mentioned position-limiting portions can be changed, such that the hinge structure has different method of switching pivoting states and is not limited in the invention.

Referring to FIG. 1 and FIG. 2, the hinge structure 100 in the embodiment further includes a fixing bracket 170*b*, a fixing bracket 170*c*, a torsion assembly 180*a*, a torsion assembly 180*b*, a washer 190*a* and a washer 190*b*. The torsion assembly 180*a* and the torsion assembly 180*b* are disposed on the first shaft 110 and the second shaft 120 respectively to provide suitable torsion for the hinge structure 100. The position-limiting mechanism 160 is disposed between the stop structure 170*a* and the fixing bracket 170*b*, the above mentioned torsion assemblies (that is the torsion assembly 180*a* and the torsion assembly 180*b*) are disposed between the fixing bracket 170*b* and the fixing bracket 170*c*, the washer 190*a* is fitted around the second shaft 120 and located between the fixing bracket 170*b* and the pivot base 130, and the washer 190*b* is fitted around the first shaft 110 and located between the stop structure 170*a* and the pivot base 130 to make the hinge structure 100 more stable.

In summary, the first bracket and the second bracket of the hinge structure in the invention are able to be connected to the display and the base of the electronic device respectively, and the hinge structure has a position-limiting mechanism which is used to control the pivoting states of the first shaft and the second shaft. In the above mentioned position-limiting mechanism, when the position-limiting component interferes with the first position-limiting portion, the first shaft is restricted from pivoting relatively to the pivot base, and when the position-limiting component interferes with the second position-limiting portion, the second shaft is restricted from pivoting relatively to the pivot base. As a result, in the process that the user turns over the display of the electronic device, the first shaft and the second shaft can be restricted to pivot in order instead of pivoting simultaneously, so as to avoid unexpected operations caused by forces exerted by the user. Thus, the display of the electronic device can be turned over smoothly between the front side and the back side of the base via the first shaft and the second shaft.

It will be apparent to those skilled in the art that various modifications and variations can be made to the structure of the invention without departing from the scope or spirit of the invention. In view of the foregoing, it is intended that the invention covers modifications and variations of this invention provided they fall within the scope of the following claims and their equivalents.

What is claimed is:

1. A hinge structure comprising:

a first shaft;

a second shaft;

a pivot base, wherein the first shaft and the second shaft are pivoted on the pivot base; and a position-limiting mechanism comprising:

a first position-limiting portion fixed to the first shaft;

a second position-limiting portion fixed to the second shaft; and a position-limiting component slidably disposed on the pivot base and having a first end and a second end opposite to each other, wherein when the position-limiting component moves to a first position, the first end and the first position-limiting portion interfere with each other to stop the first shaft and the pivot base from rotating relatively, and when the position-limiting component moves to a second position, the second end and the second position-limiting portion interfere with each other to stop the second shaft and the pivot base from rotating relatively, wherein the first shaft is pivoted on the pivot base along a first axis, the second shaft is pivoted on the pivot base along a second axis, the position-limiting component is slidably disposed on the pivot base along a third axis, and the first axis, the second axis and the third axis are parallel to each other.

2. The hinge structure according to claim 1, further comprising a first bracket and a second bracket, wherein the first bracket and the second bracket are fixed on the first shaft and the second shaft respectively, and an expanding angle between the first bracket and the second bracket is adapted to be changed through the relative pivoting between the first shaft and the pivot base or the relative pivoting between the second shaft and the pivot base.

3. The hinge structure according to claim 2, wherein the hinge structure is suitable for an electronic device, the electronic device includes a display and a base, the first bracket and the second bracket connect to the display and the base respectively.

4. The hinge structure according to claim 2, wherein when the expanding angle is less than a first angle or greater than a second angle, the position-limiting component is limited to the second position, and when the expanding angle is greater than the first angle and less than the second angle, the position-limiting component is limited to the first position, wherein the second angle is greater than the first angle.

5. The hinge structure according to claim 4, wherein the first angle is 90 degrees and the second angle is 270 degrees.

6. The hinge structure according to claim 4, further comprising a stop structure, wherein the second shaft is pivoted on the stop structure and has a bump, the stop structure has a stop block, when the expanding angle increases to the second angle through the relative pivoting between the second shaft and the pivot base, the bump contacts the stop block to stop the second shaft and the pivot base from continuing to pivot relatively, and when the expanding angle decreases to the first angle through the relative pivoting between the second shaft and the pivot base, the bump contacts the stop block to stop the second shaft and the pivot base from continuing to pivot relatively.

7. The hinge structure according to claim 4, further comprising a stop structure, wherein the first shaft is pivoted on the stop structure and has a bump, the stop structure has a stop block, when the expanding angle increases to a third angle greater than the second angle through the relative pivoting between the first shaft and the pivot base, the bump contacts the stop block to stop the first shaft and the pivot base from continuing to pivot relatively, and when the expanding angle decreases to a fourth angle less than the first angle through the relative pivoting between the second shaft and the pivot base, the bump contacts the stop block to stop the first shaft and the pivot base from continuing to pivot relatively, wherein the third angle is greater than the fourth angle.

8. The hinge structure according to claim 7, wherein the third angle is 360 degrees and the fourth angle is 0 degree.

9. The hinge structure according to claim 1, wherein the position-limiting mechanism further comprises an elastic component, the elastic component connects between the position-limiting component and the pivot base, the position-limiting component is adapted to be limited to the first position via the elastic force of the elastic component, and the first position-limiting portion is adapted to resist the elastic force of the elastic component and limits the position-limiting component to the second position.

10. The hinge structure according to claim 1, wherein the first position-limiting portion has a first concave portion, the second position-limiting portion has at least one second concave portion, when the position-limiting component is located at the first position, the first end sticks into the first concave portion to stop the relative pivoting between the first shaft and the pivot base, and when the position-limiting component is located at the second position, the second end sticks into the second concave portion to stop the relative pivoting between the second shaft and the pivot base.

11. The hinge structure according to claim 10, wherein there is at least one guiding-incline inside the first concave portion, when the position-limiting component is located at the first position and the second end is aligned to the second concave portion, the first end is adapted to move away from the first concave portion along the guiding-incline through the relative pivoting between the first shaft and the pivot base, so as to drive the position-limiting component to move from the first position to the second position.

* * * * *